US012655490B2

(12) United States Patent
Hirata et al.

(10) Patent No.: US 12,655,490 B2
(45) Date of Patent: Jun. 16, 2026

(54) METHOD FOR PRODUCING AUSTENITIC HEAT RESISTANT STEEL

(71) Applicant: NIPPON STEEL CORPORATION, Tokyo (JP)

(72) Inventors: Hiroyuki Hirata, Tokyo (JP); Masahiro Seto, Tokyo (JP); Mitsuru Yoshizawa, Tokyo (JP); Junichi Higuchi, Tokyo (JP); Takahiro Osuki, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 884 days.

(21) Appl. No.: 17/996,700

(22) PCT Filed: Apr. 21, 2021

(86) PCT No.: PCT/JP2021/016189
§ 371 (c)(1),
(2) Date: Oct. 20, 2022

(87) PCT Pub. No.: WO2021/220913
PCT Pub. Date: Nov. 4, 2021

(65) Prior Publication Data

US 2023/0220508 A1 Jul. 13, 2023

(30) Foreign Application Priority Data

Apr. 30, 2020 (JP) ..... 2020-080196

(51) Int. Cl.
*C21D 6/00* (2006.01)
*C22C 38/00* (2006.01)
(Continued)

(52) U.S. Cl.
CPC ..... *C21D 6/004* (2013.01); *C21D 6/005* (2013.01); *C21D 6/008* (2013.01); *C22C 38/001* (2013.01);
(Continued)

(58) Field of Classification Search
CPC ... C21D 1/18; C21D 1/26; C21D 1/60; C21D 2211/001; C21D 2261/00; C21D 6/004;
(Continued)

(56) References Cited

U.S. PATENT DOCUMENTS

2003/0231976 A1 12/2003 Iseda
2010/0034689 A1 2/2010 Hirata et al.
(Continued)

FOREIGN PATENT DOCUMENTS

CN 101633999 * 1/2010
CN 101633999 A 1/2010
(Continued)

*Primary Examiner* — Nicholas A Wang
(74) *Attorney, Agent, or Firm* — Greer, Burns & Crain, Ltd.

(57) ABSTRACT

A method for producing an austenitic heat resistant steel in which a difference between a content of Nb and an amount of Nb analyzed as extraction residues satisfies [$0.170 \leq Nb - Nb_{ER} \leq 0.480$], the method including: a forming step of machining and forming a steel having a predetermined chemical composition into a product shape; a solution heat treatment step of performing, after the forming step, heat treatment under conditions including a heat treatment temperature satisfying [$-250Nb+1200 \leq T \leq -100Nb+1290$] and a soaking time satisfying [$405-0.3T \leq t \leq 2475-1.5T$]; and a cooling step of performing cooling after the solution heat treatment step.

16 Claims, 1 Drawing Sheet

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |

(52) U.S. Cl.
CPC ..... *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C21D 2211/001* (2013.01)

(58) Field of Classification Search
CPC ..... C21D 6/005; C21D 6/008; C21D 6/02; C21D 8/005; C21D 8/0205; C21D 8/0226; C21D 8/0236; C21D 8/0273; C21D 8/0215; C22C 38/001; C22C 38/002; C22C 38/005; C22C 38/008; C22C 38/02; C22C 38/04; C22C 38/06; C22C 38/42; C22C 38/44; C22C 38/46; C22C 38/48; C22C 38/50; C22C 38/52; C22C 38/54
See application file for complete search history.

(56) References Cited

U.S. PATENT DOCUMENTS

| | | | |
|---|---|---|---|
| 2013/0130058 | A1 | 5/2013 | Iseda et al. |
| 2018/0051352 | A1 | 2/2018 | Kimura et al. |
| 2019/0211411 | A1 | 7/2019 | Hasegawa et al. |

FOREIGN PATENT DOCUMENTS

| | | | | |
|---|---|---|---|---|
| JP | 62133048 | A | | 6/1987 |
| JP | 2000256803 | | * | 9/2000 |
| JP | 2000256803 | A | | 9/2000 |
| JP | 2003268503 | A | | 9/2003 |
| JP | 2014001436 | A | | 1/2014 |
| KR | 1020130136335 | A | | 12/2013 |
| WO | 2009044796 | A1 | | 4/2009 |
| WO | 2013073055 | A1 | | 5/2013 |

* cited by examiner

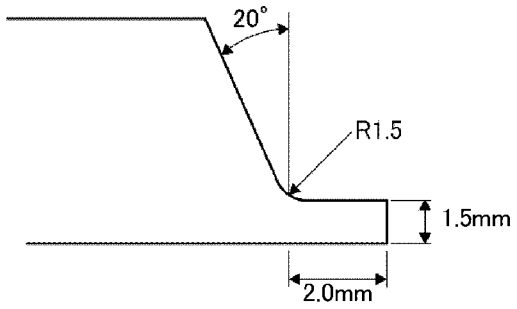
20°
R1.5
1.5mm
2.0mm

METHOD FOR PRODUCING AUSTENITIC HEAT RESISTANT STEEL

CROSS-REFERENCES TO RELATED APPLICATIONS

This is a National Phase Application filed under 35 U.S.C. § 371, of International Application No. PCT/JP2021/016189, filed Apr. 21, 2021, which claimed priority to JP 2020-080196, filed Apr. 30, 2020, the contents of which are incorporated by reference.

TECHNICAL FIELD

The present invention relates to a method for producing an austenitic heat resistant steel.

BACKGROUND ART

In a thermal power plant, operating conditions of a power generation boiler have been increasingly higher in terms of temperature and pressure so as to increase power generation efficiency from a viewpoint of reduction of environmental loads. Thus, materials of a superheater tube, a reheater tube, and the like used in the power generation boiler are required to have properties such as corrosion resistance, as well as excellent high temperature strength.

Hence, austenitic heat resisting alloys that are made to contain a large amount of Nb and N have been developed as materials having favorable high temperature strengths. For example, Patent Documents 1 to 6 each disclose an austenitic steel that is made to contain predetermined amounts of Nb and N to have an improved high temperature strength.

LIST OF PRIOR ART DOCUMENTS

Patent Document

Patent Document 1: JP62-133048A
Patent Document 2: JP2000-256803A
Patent Document 3: WO 2009/044796
Patent Document 4: WO 2013/073055
Patent Document 5: JP2014-1436A
Patent Document 6: JP2003-268503A

SUMMARY OF INVENTION

Technical Problem

When used at high temperature, the austenitic heat resistant steel s disclosed in Patent Documents 1 to 6 may prone to variation in time taken to be ruptured at a certain level of stress, and there is room for improvement in terms of providing stable creep strength. Even when the stable creep strength is provided, containing of Nb makes cracking likely to occur in welding; thus the problem is that it is difficult to establish compatibility between stable creep strength and weld crack resistance.

An objective of the present invention is to solve the problem described above and to provide a method for producing an austenitic heat resistant steel having a stable, favorable creep strength and an excellent weld crack resistance in its use at high temperature.

Solution to Problem

The present invention is made to solve the problem described above, and the gist of the present invention is the following method for producing an austenitic heat resistant steel.

(1) A method for producing an austenitic heat resistant steel in which a difference between a content of Nb and an amount of Nb analyzed as extraction residues satisfies Formula (i) shown below, the method including:

a forming step of machining and forming a steel into a product shape, the steel including a chemical composition consisting of, in mass %:

C: 0.04 to 0.12%,
Si: 0.01 to 0.30%,
Mn: 0.50 to 1.50%,
P: 0.001 to 0.040%,
S: 0.0050% or less,
Cu: 2.2 to 3.8%,
Ni: 8.0 to 11.0%,
Cr: 17.7 to 19.3%,
Mo: 0.01 to 0.55%,
Nb: 0.400 to 0.650%,
B: 0.0010 to 0.0060%,
N: 0.050 to 0.160%,
Al: 0.025% or less,
O: 0.020% or less,
Co: 0 to 1.00%,
W: 0 to 1.00%,
Ti: 0 to 0.40%,
V: 0 to 0.40%,
Ta: 0 to 0.40%,
Sn: 0 to 0.0300%,
Ca: 0 to 0.0100%,
Mg: 0 to 0.0100%, and
REM: 0 to 0.0800%,
with the balance: Fe and impurities;

a solution heat treatment step of performing, after the forming step, heat treatment under conditions including a heat treatment temperature satisfying Formula (ii) shown below and a soaking time satisfying Formula (iii) shown below; and a cooling step of performing cooling after the solution heat treatment step:

$$0.170 \leq \mathrm{Nb} - \mathrm{Nb}_{ER} \leq 0.480 \quad \text{(i)}$$

$$-250\mathrm{Nb} + 1200 \leq T \leq -100\mathrm{Nb} + 1290 \quad \text{(ii)}$$

$$405 - 0.3T \leq t \leq 2475 - 1.5T \quad \text{(iii)}$$

where a symbol of an element in the formulas indicates a content (mass %) of the element contained in the steel, and symbols in the formulas are defined as follows:

$\mathrm{Nb}_{ER}$ (mass %): amount of Nb analyzed as extraction residues

T (° C.): heat treatment temperature t (sec): soaking time.

(2) The method for producing an austenitic heat resistant steel according to the above (1), wherein in the cooling step, the cooling is performed in a form of forced cooling, and a difference between the heat treatment temperature and a temperature of the steel at a time of starting the forced cooling satisfies Formula (iv) shown below:

$$0 \leq \Delta T \leq 100\mathrm{Nb} - 5 \quad \text{(iv)}$$

where a symbol of an element in the formula indicates a content (mass %) of the element contained in the steel, and a symbol in the formula is defined as follows:

ΔT (° C.): difference between the heat treatment temperature of the solution heat treatment and the temperature of the steel at the time of starting the forced cooling.

(3) The method for producing an austenitic heat resistant steel according to the above (1) or (2), wherein a difference between a content of Nb and an amount of Nb analyzed as extraction residues satisfies Formula (v) shown below:

$$-2B + 0.185 \leq \mathrm{Nb} - \mathrm{Nb}_{ER} \leq -4B + 0.480 \quad \text{(v)}$$

where symbols of elements in the formula means the contents (mass %) of the elements contained in the steel, and $\mathrm{Nb}_{ER}$ means the amount of Nb (mass %) analyzed as extraction residues.

(4) The method for producing an austenitic heat resistant steel according to any one of the above (1) to (3), wherein the chemical composition contains one or more elements selected from, in mass %:

Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

(5) The method for producing an austenitic heat resistant steel according to any one of the above (1) to (4), wherein the chemical composition contains, in mass %, P: 0.020 to 0.040%.

Advantageous Effects of Invention

According to the present invention, it is possible to provide an austenitic heat resistant steel having a stable, favorable creep strength and an excellent weld crack resistance in its use at high temperature.

BRIEF DESCRIPTION OF DRAWING

FIG. 1 is a diagram illustrating a bevel shape in EXAMPLE.

DESCRIPTION OF EMBODIMENTS

The present inventors conducted various studies for improving a high temperature strength, specifically a creep strength, and a weld crack resistance of an austenitic heat resistant steel containing Nb and N, and obtained the following findings (a) to (c).

(a) It was found that a creep strength of steel is strongly influenced by solution heat treatment performed after a final forming step, and even the same chemical composition results in different creep strengths under different conditions of the solution heat treatment. To be specific, stable provision of a high creep strength was associated with an increase in the heat treatment temperature or the soaking time.

When a high creep strength was stably provided as described above, a precipitation amount of carbo-nitride and nitride containing Nb was small in a state before use, that is, after the solution heat treatment and cooling. In addition, in the use of the steel where the steel is exposed to high temperature, the carbo-nitride and nitride containing Nb precipitated in grains finely and densely and were present stably for a long time.

In contrast, in a case of a poor creep strength, the precipitation amount of the carbo-nitride and nitride containing Nb observed before use was large. In addition, with use, the carbo-nitride and nitride containing Nb that precipitated finely in grains were small in amount and coarsened at an early stage. Further, a steel having a small content of Nb is required to be subjected to the solution heat treatment at a higher temperature so as to provide a high creep strength stably. For those reasons, in order to provide stable creep strength, it is desirable to dissolve Nb in a matrix adequately in advance and to cause precipitates containing Nb to precipitate at a usage stage.

(b) As for the weld crack resistance, it was observed that cracking susceptibility tended to be increased with an increase in the heat treatment temperature or the soaking time. Additionally, weld cracks occur at crystal grain boundaries in a weld heat affected zone, and on a crack fracture surface, traces of local melting of grain boundaries were recognized, where concentration of Nb occurred. Further, a steel containing a large amount of Nb caused weld cracks in some cases even when the steel was subjected to the solution heat treatment at a lower temperature.

When Nb dissolved in a matrix (hereinafter, simply referred to as "dissolved Nb") is compared with Nb present in a form of its precipitate, the dissolved Nb has a greater influence on weld crack susceptibility. The reason for this is that the dissolved Nb needs no time for being dissolved in a matrix through weld thermal cycles, and the Nb is likely to be concentrated at grain boundaries. As a result, weld cracks are likely to occur.

(c) In view of the above, it is found that the amount of dissolved Nb has a major influence on both properties of creep strength and weld crack resistance. It is therefore necessary to appropriately control the amount of dissolved Nb and conditions of the solution heat treatment that influences the amount of dissolved Nb so that compatibility between stable, high creep strength and favorable weld crack resistance are established. The amount of dissolved Nb is also influenced by a content of B, and it is therefore preferable to control their ranges appropriately. In controlling the amount of dissolved Nb, it is naturally desirable to adjust a content of Nb within its appropriate range, and it is additionally desirable to manage a heat treatment temperature and a soaking time in the solution heat treatment appropriately based on the content of Nb.

The present invention is made based on the findings described above and is a method for producing an austenitic heat resistant steel in which a difference between a content of Nb and an amount of Nb analyzed as extraction residues satisfies Formula (i) described later. Requirements of the present invention will be described below.

1. Forming Step 1-1. Forming Method

In the production method according to the present invention, a steel having a chemical composition described below is machined and formed into a final shape, that is, a product shape in a forming step. A method for the machining and formation is not limited to a particular method; the method may be casting for the formation using a mold or may be plastic working. In a case where the plastic working is employed for the formation, hot rolling, hot forging, cold rolling, cold forging, cold drawing or the like is conceivable for example, and a working temperature may be within any temperature range such as a hot temperature range, a cold temperature range, and a warm temperature range. Note that heat treatment and pickling may be performed in a forming step as necessary.

The product shape provided by the machining and formation is not limited to a particular shape, either. Examples of a conceivable product shape include a plate shape, a tubular shape, a bar shape, a wire shape, an H shape, and an I shape, and in addition, a peculiar shape provided by using a mold.

1-2. Chemical Composition of Steel

In the production method according to the present invention, it is also important to control a chemical composition of a steel to be machined and formed. The chemical composition of the steel being a starting material to be subjected to plastic forming is controlled by, for example, melting and refining a starting material having predetermined chemical components. The starting material is typically produced into ingots or blooms by casting. The ingots or blooms are then subjected to plastic working such as hot rolling and cold rolling.

A chemical composition of a steel to be a starting material for working will be described below. In the description, the symbol "%" for contents means "mass %" unless otherwise noted.

C: 0.04 to 0.12%

C (carbon) stabilizes an austenitic structure and forms fine carbides, improving creep strength in high-temperature use of the austenitic heat resistant steel. A content of C is thus set to 0.04% or more. The content of C is preferably set to 0.06% or more, and more preferably set to 0.07% or more. However, if C is contained excessively, the effect of C is saturated, and carbides precipitate in a large quantity, decreasing creep ductility. The content of C is thus set to 0.12% or less. The content of C is preferably set to 0.10% or less, and more preferably set to 0.09% or less.

Si: 0.01 to 0.30%

Si (silicon) has a deoxidation effect in the process of production. Further, Si is an element useful in improving corrosion resistance and oxidation resistance at high temperature. A content of Si is thus set to 0.01% or more. The content of Si is preferably set to 0.03% or more, and more preferably set to 0.05% or more. However, if Si is contained excessively, stability of an austenitic structure is decreased, leading to a decrease in toughness and creep strength. The content of Si is thus set to 0.30% or less. The content of Si is preferably set to 0.28% or less, and more preferably set to 0.25% or less.

Mn: 0.50 to 1.50%

As with Si, Mn (manganese) has a deoxidation effect. In addition, Mn stabilizes an austenitic structure, contributing to improvement of creep strength. A content of Mn is thus set to 0.50% or more. The content of Mn is preferably set to 0.60% or more, and more preferably set to 0.70% or more. However, if Mn is contained excessively, the excessively contained Mn leads to embrittlement, further resulting in a decrease in creep ductility. The content of Mn is thus set to 1.50% or less. The content of Mn is preferably set to 1.30% or less, and more preferably set to 1.00% or less.

P: 0.001 to 0.040%

P (phosphorus) is an element contained in the steel as an impurity, and if P is reduced excessively, production costs are increased; therefore, a content of P is thus set to 0.001% or more. The content of P is preferably set to 0.005% or more, and more preferably set to 0.010% or more. Further, P has an effect of increasing creep strength. To exert the effect, the content of P is preferably set to 0.020% or more.

However, if P is contained excessively, crack susceptibility of a weld heat affected zone in welding is increased. The content of P is thus set to 0.040% or less. The content of P is preferably set to 0.038% or less, and more preferably set to 0.035% or less.

S: 0.0050% or less

As with P, S (sulfur) is contained in the steel as an impurity and increases crack susceptibility of a weld heat affected zone in welding. A content of S is thus set to 0.0050% or less. The content of S is preferably set to 0.0040% or less, and more preferably set to 0.0020% or less. Note that the content of S is preferably reduced as much as possible, but an extreme reduction of the content of S leads to a rise in steel making costs. The content of S is thus preferably set to 0.0001% or more, and preferably 0.0002% or more.

Cu: 2.2 to 3.8%

Cu (copper) increases stability of an austenitic structure and finely precipitates in use of the austenitic heat resistant steel, contributing to improvement of creep strength. A content of Cu is thus set to 2.2% or more. The content of Cu is preferably set to 2.5% or more, and more preferably set to 2.7% or more. However, if Cu is contained excessively, hot workability is decreased. The content of Cu is thus set to 3.8% or less. The content of Cu is preferably set to 3.5% or less, and more preferably set to 3.3% or less.

Ni: 8.0 to 11.0%

Ni (nickel) stabilizes an austenitic structure, contributing to improvement of creep strength. A content of Ni is thus set to 8.0% or more. The content of Ni is preferably set to 8.2% or more, and more preferably set to 8.5% or more. However, since Ni is an expensive element, a high content of Ni leads to a rise in costs. The content of Ni is thus set to 11.0% or less. The content of Ni is preferably set to 10.8% or less, more preferably set to 10.5% or less, and still more preferably set to 10.3% or less.

Cr: 17.7 to 19.3%

Cr (chromium) contributes to improvement of oxidation resistance and corrosion resistance at high temperature. Cr also forms its fine carbide, contributing to ensuring of creep strength. A content of Cr is thus set to 17.7% or more. The content of Cr is preferably set to 18.0% or more, and more preferably set to 18.2% or more. However, if Cr is contained excessively, stability of an austenitic structure is impaired, decreasing creep strength. The content of Cr is thus set to 19.3% or less. The content of Cr is preferably set to 19.0% or less, and more preferably set to 18.8% or less.

Mo: 0.01 to 0.55%

Mo (molybdenum) is dissolved in a matrix, contributing to improvement of creep strength and tensile strength at high temperature. A content of Mo is thus set to 0.01% or more. The content of Mo is preferably set to 0.03% or more, and more preferably set to 0.05% or more. However, if Mo is contained excessively, the effect of Mo is saturated. Further, stability of an austenitic structure is impaired, rather resulting in a decrease in creep strength. Further, since Mo is an expensive element, excessive containing of Mo leads to a rise in costs. The content of Mo is thus set to 0.55% or less. The content of Mo is preferably set to 0.53% or less, more preferably set to 0.50% or less, and still more preferably set to 0.40% or less.

Nb: 0.400 to 0.650%

Nb (niobium) precipitates in a form of its fine carbonitride and fine nitride, contributing to improvement of creep strength. A content of Nb is thus set to 0.400% or more. The content of Nb is preferably set to 0.420% or more, and more preferably set to 0.450% or more. However, if Nb is contained excessively, the excessively contained Nb leads to occurrence of weld cracks at a weld heat affected zone in welding. In addition, carbo-nitride and nitride of Nb precipitate in a large quantity, decreasing ductility of the material. The content of Nb is thus set to 0.650% or less. The content of Nb is preferably set to 0.630% or less, and more preferably set to 0.600% or less.

Note that the content of Nb means the amount of Nb contained in the austenitic heat resistant steel. That is, the content of Nb means a total of an amount of dissolved Nb and an amount of Nb present in a form of its precipitate. For the production method according to the present invention, an amount of dissolved Nb, namely, a difference between the content of Nb and an amount of Nb that is analyzed as extraction residues (an amount of Nb present in a form of its precipitate) is controlled as a predetermined range of the content of Nb.

B: 0.0010 to 0.0060%

B (boron) has an effect of finely dispersing grain boundary carbides, improving creep strength. A content of B is thus set to 0.0010% or more. The content of B is preferably set to 0.0020% or more, and more preferably set to 0.0030% or more. However, if B is contained excessively, crack susceptibility of a weld heat affected zone in welding is increased. The content of B is thus set to 0.0060% or less. The content of B is preferably set to 0.0055% or less, and more preferably set to 0.0050% or less.

N: 0.050 to 0.160%

N (nitrogen) stabilizes an austenitic structure and is dissolved or precipitates in a form of nitrides, contributing to improvement of creep strength. A content of N is thus set to 0.050% or more. The content of N is preferably set to 0.070% or more, and more preferably set to 0.090% or more. However, if N is contained excessively, fine nitrides precipitate in a large quantity, leading to a decrease in creep ductility and toughness. The content of N is thus set to 0.160% or less. The content of N is preferably set to 0.140% or less, and more preferably set to 0.120% or less.

Al: 0.025% or less

Al (aluminum) has a deoxidation effect. However, if Al is contained excessively, cleanliness of the steel deteriorates, and hot workability is decreased. A content of Al is thus set to 0.025% or less. The content of Al is preferably set to 0.023% or less, more preferably set to 0.020% or less, and still more preferably set to 0.0017% or less. On the other hand, an extreme reduction of Al leads to a rise in steel making costs and in addition fails to provide the effect. The content of Al is thus preferably set to 0.001% or more, and more preferably set to 0.002% or more.

O: 0.020% or less

O (oxygen) is contained in the steel as an impurity, and if O is contained excessively, hot workability is decreased. In addition, toughness and ductility are impaired. A content of O is thus set to 0.020% or less. The content of O is preferably set to 0.018% or less, and more preferably set to 0.015% or less. Note that no particular lower limit will be imposed on the content of O, but an extreme reduction of the content of O results in a rise in production costs. The content of O is thus preferably set to 0.001% or more, and more preferably set to 0.002% or more.

In the chemical composition, in addition to the elements described above, one or more elements selected from Co, W, Ti, V, Ta, Sn, Ca, Mg, and REM may be contained within their respective ranges described below. Reasons for limiting a content of each element will be described.

Co: 0 to 1.00%

As with Ni, Co (cobalt) has an effect of stabilizing an austenitic structure, contributing to improvement of creep strength. Thus, it may be contained as necessary. However, Co is a very expensive element, and if Co is contained excessively, costs rise. A content of Co is thus set to 1.00% or less. The content of Co is preferably set to 0.90% or less, and more preferably set to 0.80% or less. On the other hand, to exert the effect, the content of Co is preferably set to 0.01% or more, and more preferably set to 0.03% or more.

W: 0 to 1.00%

W (tungsten) has an effect of improving creep strength at high temperature by being dissolved in a matrix or forming its fine intermetallic compound phases. Thus, it may be contained as necessary. However, even if W is contained excessively, the effect is saturated, and stability of an austenitic structure is impaired, rather resulting in a decrease in creep strength. Further, since W is an expensive element, excessive containing of W results in a rise in production costs. A content of W is thus set to 1.00% or less. The content of W is preferably set to 0.90% or less, and more preferably set to 0.80% or less. On the other hand, to exert the effect, the content of W is preferably set to 0.01% or more, and more preferably set to 0.03% or more.

Ti: 0 to 0.40%

Ti (titanium) combines with carbon and nitrogen to form its fine carbide and fine carbo-nitride, having an effect of improving creep strength at high temperature. Thus, it may be contained as necessary. However, if Ti is contained excessively, its precipitate precipitates in a large quantity, leading to a decrease in creep ductility and toughness. A content of Ti is thus set to 0.40% or less. The content of Ti is preferably set to 0.35% or less, and more preferably set to 0.30% or less. On the other hand, to exert the effect, the content of Ti is preferably set to 0.01% or more, and more preferably set to 0.02% or more.

V: 0 to 0.40%

As with Ti, V (vanadium) forms its fine carbide and fine carbo-nitride, having an effect of improving creep strength at high temperature. Thus, it may be contained as necessary. However, if V is contained excessively, its precipitate precipitates in a large quantity, leading to a decrease in creep ductility and toughness. A content of V is thus set to 0.40% or less. The content of V is preferably set to 0.35% or less, and more preferably set to 0.30% or less. On the other hand, to exert the effect, the content of V is preferably set to 0.01% or more, and more preferably set to 0.02% or more.

Ta: 0 to 0.40%

As with Ti and V, Ta (tantalum) forms its fine carbide and fine carbo-nitride, having an effect of improving creep strength at high temperature. Thus, it may be contained as necessary. However, if Ta is contained excessively, its precipitate precipitates in a large quantity, leading to a decrease in creep ductility and toughness. A content of Ta is thus set to 0.40% or less. The content of Ta is preferably set to 0.35% or less, and more preferably set to 0.30% or less. On the other hand, to exert the effect, the content of Ta is preferably set to 0.01% or more, and more preferably set to 0.02% or more.

Sn: 0 to 0.0300%

Sn (tin) has an effect of increasing weldability considerably. Thus, it may be contained as necessary. However, if Sn is contained excessively, crack susceptibility of a weld heat affected zone in welding is increased, and hot workability in the process of production is impaired. A content of Sn is thus set to 0.0300% or less. The content of Sn is preferably set to 0.0250% or less, and more preferably set to 0.0200% or less.

On the other hand, to exert the effects, the content of Sn is preferably set to 0.0002% or more, and more preferably set to 0.0005% or more.

Ca: 0 to 0.0100%

Ca (calcium) has an effect of improving hot workability. Thus, it may be contained as necessary. However, if Ca is contained excessively, Ca combines with oxygen, which decreases cleanliness significantly, rather impairing hot workability. A content of Ca is thus set to 0.0100% or less. The content of Ca is preferably set to 0.0080% or less, and more preferably set to 0.0060% or less. On the other hand, to exert the effects, the content of Ca is preferably set to 0.0002% or more, and more preferably set to 0.0005% or more.

Mg: 0 to 0.0100%

As with Ca, Mg (magnesium) has an effect of improving hot workability. Thus, it may be contained as necessary. However, if Mg is contained excessively, Mg combines with oxygen, which decreases cleanliness significantly. As a result, hot workability is rather decreased. A content of Mg is thus set to 0.0100% or less. The content of Mg is preferably set to 0.0080% or less, and more preferably set to 0.0060% or less. On the other hand, to exert the effects, the content of Mg is preferably set to 0.0002% or more, and more preferably set to 0.0005% or more.

REM: 0 to 0.0800%

As with Ca and Mg, REM has an effect of improving hot workability in the process of production. Thus, it may be contained as necessary. However, if REM is contained excessively, REM combines with oxygen, which decreases cleanliness significantly. As a result, hot workability is rather decreased. A content of REM is thus set to 0.0800% or less. The content of REM is preferably set to 0.0600% or less, and more preferably set to 0.0500% or less. On the other hand, to exert the effect, the content of REM is preferably set to 0.0005% or more, and more preferably set to 0.0010% or more.

REM refers to Sc (scandium), Y (yttrium), and lanthanoids, 17 elements in total, and the content of REM means a total content of these elements. Industrially, REM is often added in a form of misch metal.

In the chemical composition according to the present invention, the balance is Fe and impurities. The term "impurities" herein means components that are mixed in steel in producing the steel industrially from raw materials such as ores and scraps and due to various factors in the producing process, and are allowed to be mixed in the steel within their respective ranges in which the impurities have no adverse effect on the present invention.

2. Solution Heat Treatment Step

Of Nb contained in the steel, Nb that is present in a form of its precipitate before the use of the austenitic heat resistant steel contributes to creep strength, but the effect provided by the contribution is minor. In contrast, dissolved Nb precipitates finely and densely in grains in a form of its carbo-nitride or its nitride in use of the austenitic heat resistant steel at high temperature for a long time, greatly contributing to improvement of creep strength and stabilization of the improved creep strength.

In addition, even when the dissolved Nb is adequate, if a heat treatment temperature in the solution heat treatment is too low, or a soaking time in the solution heat treatment is too short, residual strain induced in prior steps is not released sufficiently, and the carbo-nitride or the nitride coarsens in an early stage in use of the austenitic heat resistant steel at high temperature, and the precipitation strengthening effect of the dissolved Nb disappears in an early stage. As a result, creep strength is less likely to be stable.

Further, when an austenitic heat resistant steel is welded, Nb segregates at crystal grain boundaries in a weld heat affected zone through weld thermal cycles. Nb lowers a solidus temperature of steel, and thus the crystal grain boundaries at which Nb segregates are locally melted, causing weld cracks. Of Nb contained in the steel, the dissolved Nb has a great influence on weld crack susceptibility because the dissolved Nb does not take long to be dissolved in a matrix through weld thermal cycles.

In addition, if the heat treatment temperature in the solution heat treatment is too high, or the soaking time in the solution heat treatment is too long, grains coarsen in the heat treatment, and a grain boundary area per unit volume decreases; therefore, during welding, an amount of Nb segregating at grain boundaries increases, and thermal stress acting on a particular grain boundary increases, resulting in an increase in weld crack susceptibility.

Accordingly, from a viewpoint of creep strength, it is necessary before use of the austenitic heat resistant steel to ensure an amount of dissolved Nb effective in precipitation strengthening and to cause carbo-nitride and nitride containing Nb to precipitate effectively. At the same time, from a viewpoint of the weld crack resistance, it is necessary to prevent grain-boundary segregation of Nb while ensuring an amount of dissolved Nb necessary for improving creep strength. For those reasons, the solution heat treatment is performed under conditions including heat treatment temperature and duration described below, after the forming step.

Specifically, in the solution heat treatment step, heat treatment is performed after the forming step under conditions including a heat treatment temperature satisfying Formula (ii) shown below and a soaking time satisfying Formula (iii) shown below. That is, holding is performed at the heat treatment temperature satisfying Formula (ii) shown below for the soaking time satisfying Formula (iii) shown below.

$$-250\text{Nb} + 1200 \leq T \leq -100\text{Nb} + 1290 \quad \text{(ii)}$$

$$405 - 0.3T \leq t \leq 2475 - 1.5T \quad \text{(iii)}$$

where a symbol of an element in the formula indicates a content (mass %) of the element contained in the steel, and symbols in the formulas are defined as follows.

T (° C.): heat treatment temperature t (sec): soaking time.

If the heat treatment temperature in the solution heat treatment is less than the left side value of Formula (ii), precipitate containing Nb formed before the forming step is not dissolved in a matrix sufficiently, failing to ensure a sufficient amount of dissolved Nb. In addition, residual strain induced in the forming step cannot be removed by the solution heat treatment. As a result, the carbo-nitride or nitride containing Nb does not precipitate finely and densely for a long time in a usage environment where the austenitic heat resistant steel is exposed to high temperature, failing to provide stable creep strength. The heat treatment temperature is therefore set to not less than the left side value of Formula (ii).

On the other hand, if the heat treatment temperature is more than the right side value of Formula (ii), although the amount of dissolved Nb is sufficient, an increase in weld crack susceptibility at a weld heat affected zone due to grain-boundary segregation of Nb is incurred as well as coarsening of grains. The heat treatment temperature is therefore set to not more than the right side value of Formula (ii).

Likewise, if the soaking time is less than the left side value of Formula (iii), precipitate containing Nb is not dissolved in a matrix sufficiently, failing to ensure a sufficient amount of dissolved Nb. In addition, residual strain induced in the forming step cannot be removed by the solution heat treatment. As a result, the carbo-nitride or nitride containing Nb does not precipitate finely and densely for a long time in a usage environment where the austenitic heat resistant steel is exposed to high temperature, failing to provide stable creep strength. The soaking time is therefore set to not less than the left side value of Formula (iii).

On the other hand, if the soaking time is more than the right side value of Formula (iii), although the amount of dissolved Nb is sufficient, an increase in weld crack susceptibility at a weld heat affected zone due to grain-boundary segregation of Nb is incurred as well as coarsening of grains. The soaking time is therefore set to not more than the right side value of Formula (iii).

In view of the above. by performing the heat treatment in the solution heat treatment under the conditions satisfying Formulas (ii) and (iii) shown above, it is possible to prevent the coarsening of grains as well as the grain-boundary segregation of Nb while ensuring the amount of dissolved Nb and to remove residual strain. Note that an atmosphere in the solution heat treatment is only required to conform to a conventional method; conceivable atmospheres include, for example, an air atmosphere regularly used in a heat treatment for a steel product or an atmosphere for bright heat treatment.

3. Cooling Step

In a cooling step, cooling is performed after the solution heat treatment, that is, after the holding at the heat treatment temperature and for the soaking time. In the cooling, a cooling rate for a temperature range of 1000 to 600° C. is preferably set to 0.4° C./s or more, and more preferably set to 1.0° C./s or more. A method for the cooling in the cooling step is not limited to a particular method, but water cooling or forced air cooling is preferable. In addition, the cooling is only required to be performed at least to a temperature range of 300° C. or less.

A preferable method for the cooling is forced cooling in which the cooling is forcibly performed by spraying coolant such as water and air on the steel. Examples of the forced cooling include water cooling and forced air cooling. When the forced cooling is performed, a difference between the heat treatment temperature and a temperature of the steel at a time of starting the forced cooling preferably satisfies Formula (iv) shown below. Note that the heat treatment temperature means a temperature of the steel at a time of performing the heat treatment, and the temperature of the steel means a surface temperature of the steel.

$$0 \leq \Delta T \leq 100\text{Nb} - 5 \quad \text{(iv)}$$

where a symbol of an element in the formula indicates a content (mass %) of the element contained in the steel, and a symbol in the formula is defined as follows.

ΔT (° C.): difference between the heat treatment temperature of the solution heat treatment and the temperature of the steel at the time of starting the forced cooling The difference between the heat treatment temperature of the solution heat treatment and the temperature of the steel at the time of starting the forced cooling (hereinafter, simply referred to as "cooling start temperature difference") is preferably 0° C. However, it is difficult for a normal equipment system, for example, in the process of production using an actual machine, to bring the cooling start temperature difference to 0° C. The cooling start temperature difference is therefore more preferably 1° C. or more, and still more preferably is 2° C. or more.

On the other hand, if the cooling start temperature difference is more than the right side value of Formula (iv), precipitates containing Nb coarsely reprecipitate by a start of the forced cooling, reducing the amount of dissolved Nb, which makes it less likely to provide stable creep strength. The cooling start temperature difference is therefore preferably not more than the right side value of Formula (iv).

5. Amount of Dissolved Nb

In a production method according to the present invention, the amount of dissolved Nb, which is an amount of Nb dissolved in a matrix, is controlled through the solution heat treatment and the subsequent cooling step. Specifically, a difference between the content of Nb and an amount of Nb analyzed as extraction residues, the difference being equivalent to the amount of dissolved Nb, is needed to satisfy Formula (i) shown below.

$$0.170 \leq \text{Nb} - \text{Nb}_{ER} \leq 0.480 \quad \text{(i)}$$

where a symbol of an element in the formula indicates a content (mass %) of the element contained in the steel, and a symbol in the formula is defined as follows.

$\text{Nb}_{ER}$ (mass %): amount of Nb analyzed as extraction residues

If the amount of dissolved Nb, which is the middle value of Formula (i), is less than 0.170%, a state where carbo-nitride and nitride containing Nb precipitate is brought about before the austenitic heat resistant steel is exposed to a usage environment, and as a result, the carbo-nitride and nitride containing Nb do not precipitate finely in grains at high-temperature use of the austenitic heat resistant steel. In addition, these precipitates coarsen at an early stage. This results in a failure to improve creep strength. The amount of dissolved Nb is therefore set to 0.170% or more. The amount of dissolved Nb is preferably set to 0.180% or more.

However, if the amount of dissolved Nb is more than 0.480%, weld crack susceptibility of a weld heat affected zone is further increased in welding. The amount of dissolved Nb is therefore set to 0.480% or less. The amount of dissolved Nb is preferably set to 0.460% or less.

Further, it is preferable to adjust the amount of dissolved Nb, with consideration given to the effect of B of increasing creep strength by being dissolved in the Cr carbide and finely precipitating at grain boundaries. Specifically, it is preferable that the amount of dissolved Nb satisfy Formula (v) shown below.

$$-2B + 0.185 \leq \text{Nb} - \text{Nb}_{ER} \leq -4B + 0.480 \quad \text{(v)}$$

where symbols of elements in the formula mean the contents (mass %) of the elements contained in the steel, and $Nb_{ER}$ means the amount of Nb (mass %) analyzed as extraction residues.

This is because when the amount of dissolved Nb is not less than the left side value of Formula (v), after the amount of dissolved Nb is ensured, the carbide in which B is dissolved finely precipitates at grain boundaries, further improving creep strength. At the same time, this is because when the amount of dissolved Nb is not more than the right side value of Formula (v), weld crack resistance can be improved.

Note that the amount of Nb analyzed as extraction residues in the formula above can be measured by the following procedure. From the steel, a test specimen having a predetermined size is taken. This test specimen is subjected to anodic dissolution by a constant-current electrolysis with a current density of 20 mA/cm$^2$ in which 10 vol. % acetylacetone-1 mass % tetramethylammonium chloride methanol solution is used as its electrolyte, by which carbo-nitrides and nitrides are extracted as residues. The extracted residues are subjected to acid decomposition and then inductively coupled plasma (ICP) optical emission spectrometry, by which a mass of Nb in the residues is measured. By dividing the mass of Nb in the residues by a dissolved mass of the test material, an amount of Nb present in a form of its carbo-nitride and nitride is determined. The determined amount of Nb is the amount of Nb analyzed as the extraction residues.

The present invention will be described below more specifically with reference to examples, but the present invention is not limited to these examples.

Example

Steel types A to K having chemical compositions shown in Table 1 were melted and cast into ingots, and the ingots were subjected to hot forging to have a thickness of 25 mm, subjected to hot rolling to have a thickness of 18 mm, and then subjected to cold rolling to be formed to have a thickness of 12 mm.

TABLE 1

| Steel | Chemical composition (mass %, Balance: Fe and Impurities) | | | | | | | | | | | | |
|---|---|---|---|---|---|---|---|---|---|---|---|---|---|
| type | C | Si | Mn | P | S | Cu | Ni | Cr | Mo | Nb | B | N | Al |
| A | 0.08 | 0.20 | 0.78 | 0.030 | 0.0008 | 3.0 | 8.7 | 18.2 | 0.10 | 0.502 | 0.0038 | 0.105 | 0.008 |
| B | 0.07 | 0.18 | 0.70 | 0.035 | 0.0010 | 3.3 | 9.6 | 18.5 | 0.08 | 0.479 | 0.0040 | 0.097 | 0.010 |
| C | 0.09 | 0.25 | 0.60 | 0.020 | 0.0016 | 2.5 | 8.5 | 18.8 | 0.52 | 0.631 | 0.0029 | 0.070 | 0.009 |
| D | 0.06 | 0.05 | 0.97 | 0.038 | 0.0035 | 2.7 | 10.5 | 18.2 | 0.05 | 0.452 | 0.0053 | 0.146 | 0.014 |
| E | 0.10 | 0.15 | 0.52 | 0.021 | 0.0020 | 2.5 | 8.8 | 19.0 | 0.50 | 0.417 | 0.0020 | 0.091 | 0.020 |
| F | 0.05 | 0.03 | 1.25 | 0.025 | 0.0011 | 3.7 | 10.8 | 18.0 | 0.03 | 0.600 | 0.0050 | 0.135 | 0.013 |
| G | 0.06 | 0.19 | 0.75 | 0.018 | 0.0015 | 2.4 | 8.3 | 18.9 | 0.03 | 0.410 | 0.0015 | 0.072 | 0.010 |
| H | 0.05 | 0.22 | 0.72 | 0.010 | 0.0012 | 2.5 | 8.4 | 19.0 | 0.04 | 0.418 | 0.0014 | 0.074 | 0.012 |
| I | 0.06 | 0.28 | 0.51 | 0.028 | 0.0006 | 2.3 | 8.2 | 18.9 | 0.51 | 0.379 | 0.0014 | 0.071 | 0.008 |
| J | 0.04 | 0.22 | 1.19 | 0.038 | 0.0038 | 3.7 | 9.0 | 18.5 | 0.09 | 0.692 | 0.0055 | 0.110 | 0.011 |
| K | 0.05 | 0.25 | 0.70 | 0.017 | 0.0013 | 2.3 | 8.2 | 19.0 | 0.04 | 0.422 | 0.0013 | 0.070 | 0.013 |

| Steel | Chemical composition (mass %, Balance: Fe and Impurities) | | | | | | | | | |
|---|---|---|---|---|---|---|---|---|---|---|
| type | O | Co | W | Ti | V | Ta | Sn | Ca | Mg | REM |
| A | 0.008 | — | — | — | — | — | — | — | — | — |
| B | 0.007 | 0.05 | — | — | — | 0.03 | — | 0.0012 | — | — |
| C | 0.010 | — | — | — | — | — | — | — | — | — |
| D | 0.012 | — | 0.08 | — | — | — | 0.0034 | — | — | 0.0018 |
| E | 0.010 | — | — | — | — | — | — | — | — | — |
| F | 0.009 | — | — | 0.04 | 0.03 | — | — | — | 0.0008 | — |
| G | 0.012 | — | — | — | — | — | — | — | — | — |
| H | 0.011 | — | — | — | — | — | — | — | — | — |
| I | 0.009 | — | — | — | — | — | — | — | — | — |
| J | 0.010 | — | — | — | — | — | — | — | — | — |
| K | 0.009 | — | — | — | — | — | — | — | — | — |

Underline value: indicating that the value fell out of the range in the chemical composition specified in the present invention.

Thereafter, from the starting materials subjected to the cold rolling, sheet materials that were 12 mm thick×100 mm wide×100 mm long were fabricated by machining. For the steel types A, C, and E, from their starting materials subjected to the hot rolling, sheet materials that were 15 mm thick×100 mm wide×100 mm long were additionally fabricated by machining. Thereafter, these sheet materials were subjected to solution heat treatment in which the holding was performed at the heat treatment temperatures and for the soaking time, the heat treatment temperature and the soaking time being changed for each example, as shown in Tables 2 to 4.

Thereafter, the water cooling or the forced air cooling was started from the heat treatment temperature such that cooling start temperature differences shown in Tables 2 to 4 were brought about. The water cooling or the forced air cooling was performed until temperatures of the steels reached at least 300° C. or less, so that steels including an austenitic structure were given, which were used as test materials. Note that examples where their cooling start temperature differences are 0° C. indicate that the cooling was performed immediately after the solution heat treatment. Here, in every method for the cooling, its cooling rate was 0.4° C./s or more in the temperature range of 1000 to 600° C.

The resultant test materials were each subjected to the constant-current electrolysis, by which the amount of Nb analyzed as extraction residues was measured. Specifically, from each test material, an 8 mm square test specimen having a length of 40 mm was taken, and the test specimen was subjected to anodic dissolution by a constant-current electrolysis with a current density of 20 mA/cm$^2$ in which 10 vol. % acetylacetone-1 mass % tetramethylammonium chloride methanol solution was used as its electrolyte, by which carbo-nitrides and nitrides were extracted as residues. The extracted residues were subjected to acid decomposition and then inductively coupled plasma (ICP) optical emission spectrometry, by which a mass of Nb in the residues is measured, and the measured mass of Nb in the residues was divided by a dissolved mass of the test material, by which an amount of Nb present in a form of its carbo-nitride and nitride was determined.

In addition, from the resultant test materials, round-bar creep test specimens were taken, which were subjected to a creep rupture test. The creep rupture test was conducted under conditions of 650° C.×216 MPa with a target rupture time of a base metal set to 1000 hours, and evaluation in the creep rupture test was such that a test specimen with the rupture time that exceeded the target rupture time or satisfied 95% or more of the target rupture time was rated as "excellent", a test specimen with the rupture time that was 90% or more to less than 95% of the target rupture time was rated as "acceptable", the test specimen being rated as "excellent" or "acceptable" was regarded as "good", and a test specimen with the rupture time that was less than 90% of the target rupture time was rated as "failed".

The resultant test materials were machined to be thinned to have a thickness of 8 mm and then subjected to beveling illustrated in. FIG. 1 at their end faces in their longitudinal direction. Grooved faces of each test material were butted against each other, and the test specimen was subjected to restraint-weld at its four sides on a commercial steel plate equivalent to SM400B specified in JIS G 3106:2008 (20 mm thick, 150 mm wide, and 150 mm long) with a covered electrode specified in A5.11-2005 ENiCrFe-3 and then subjected to multi-pass weld in the groove by automatic gas tungsten arc welding. For the welding, AWS A5.14-2009 ERNiCr-3 having an outer diameter of 1.2 mm was used as a filler material, and its heat input was set to about 9 to 12 kJ/cm. Further, Ar was used as shielding gas and back shielding gas for the welding, with its flow rate set to 10 L/min.

From each of the resultant welded joints, five cross sections were made to appear, mirror-polished, etched, and then subjected to microscopic examination under an optical microscope, by which whether any crack was present or not in a weldment was examined. A welded joint for which no crack was observed on its five samples was rated as "excellent", a welded joint for which a crack was observed on one of the samples was rated as "acceptable", the welded joint being rated as "excellent" or "acceptable" was regarded as "good", and a welded joint for which cracks were observed on two or more of the samples was rated as "failed".

TABLE 2

| | | | Solution heat treatment step | | | | | | Cooling step | | |
|---|---|---|---|---|---|---|---|---|---|---|---|
| | | | | | | | | | Cooling | | |
| Test piece | Steel type | Forming step Processing method | Heat treatment temperature T (° C.) | Left side value of Formula (ii) | Right side value of Formula (ii) | Soaking time t(s) | Left side value of Formula (iii) | Right side value of Formula (iii) | start temperature difference ΔT (° C.) | Right side value of Formula (iv) | Cooling method |
| A1 | A | Cold rolling | 1150 | 1075 | 1240 | 120 | 60 | 750 | 0 | 45.2 | Water cooling |
| A2 | A | Cold rolling | 1150 | 1075 | 1240 | 60 | 60 | 750 | 0 | 45.2 | Water cooling |
| A3 | A | Cold rolling | 1150 | 1075 | 1240 | 90 | 60 | 750 | 0 | 45.2 | Water cooling |
| A4 | A | Cold rolling | 1150 | 1075 | 1240 | 300 | 60 | 750 | 0 | 45.2 | Water cooling |
| A5 | A | Cold rotting | 1150 | 1075 | 1240 | 600 | 60 | 750 | 0 | 45.2 | Water cooling |
| A6 | A | Cold rolling | 1150 | 1075 | 1240 | 720 | 60 | 750 | 0 | 45.2 | Water cooling |
| A7 | A | Cold rolling | 1100 | 1075 | 1240 | 120 | 75 | 825 | 0 | 45.2 | Water cooling |
| A8 | A | Cold rolling | 1100 | 1075 | 1240 | 60 * | 75 | 825 | 0 | 45.2 | Water cooling |
| A9 | A | Cold rolling | 1100 | 1075 | 1240 | 90 | 75 | 825 | 0 | 45.2 | Water cooling |

TABLE 2-continued

| | | | | | | | | | | | |
|---|---|---|---|---|---|---|---|---|---|---|---|
| A10 | A | Cold rolling | 1100 | 1075 | 1240 | 300 | 75 | 825 | 0 | 45.2 | Water cooling |
| A11 | A | Cold rolling | 1100 | 1075 | 1240 | 600 | 75 | 825 | 0 | 45.2 | Water cooling |
| A12 | A | Cold rolling | 1100 | 1075 | 1240 | 720 | 75 | 825 | 0 | 45.2 | Water cooling |
| A13 | A | Cold rolling | 1200 | 1075 | 1240 | 120 | 45 | 675 | 0 | 45.2 | Water cooling |
| A14 | A | Cold rolling | 1200 | 1075 | 1240 | 60 | 45 | 675 | 0 | 45.2 | Water cooling |
| A15 | A | Cold rolling | 1200 | 1075 | 1240 | 90 | 45 | 675 | 0 | 45.2 | Water cooling |
| A16 | A | Cold rolling | 1200 | 1075 | 1240 | 300 | 45 | 675 | 0 | 45.2 | Water cooling |
| A17 | A | Cold rolling | 1200 | 1075 | 1240 | 600 | 45 | 675 | 0 | 45.2 | Water cooling |
| A18 | A | Cold rolling | 1200 | 1075 | 1240 | 720 * | 45 | 675 | 0 | 45.2 | Water cooling |
| A19 | A | Cold rolling | 1070 * | 1075 | 1240 | 120 | 84 | 870 | 0 | 45.2 | Water cooling |
| A20 | A | Cold rolling | 1230 | 1075 | 1240 | 120 | 36 | 630 | 0 | 45.2 | Water cooling |
| A21 | A | Hot rolling | 1150 | 1075 | 1240 | 120 | 60 | 750 | 0 | 45.2 | Water cooling |
| A22 | A | Cold roiling | 1150 | 1075 | 1240 | 120 | 60 | 750 | 0 | 45.2 | Forced air cooling |
| A23 | A | Cold rolling | 1150 | 1075 | 1240 | 120 | 60 | 750 | 10 | 45.2 | Water cooling |
| A24 | A | Cold rolling | 1150 | 1075 | 1240 | 120 | 60 | 750 | 30 | 45.2 | Water cooling |
| A25 | A | Cold roiling | 1150 | 1075 | 1240 | 120 | 60 | 750 | 50 ** | 45.2 | Water cooling |
| A26 | A | Cold rolling | 1200 | 1075 | 1240 | 40 * | 45 | 675 | 0 | 45.2 | Water cooling |
| A27 | A | Cold rolling | 1200 | 1075 | 1240 | 50 | 45 | 675 | 0 | 45.2 | Water cooling |
| A28 | A | Cold rolling | I200 | 1075 | 1240 | 670 | 45 | 675 | 0 | 45.2 | Water cooling |
| A29 | A | Cold rolling | 1200 | 1075 | 1240 | 680 * | 45 | 675 | 0 | 45.2 | Water cooling |
| A30 | A | Cold rolling | 1080 | 1075 | 1240 | 120 | 81 | 855 | 0 | 45.2 | Water cooling |
| A31 | A | Cold rolling | 1250 * | 1075 | 1240 | 120 | 30 | 600 | 0 | 45.2 | Water cooling |
| B1 | B | Cold rolling | 1150 | 1080 | 1242 | 120 | 60 | 750 | 0 | 42.9 | Water cooling |

| Test piece | Content of Nd (mass %) | Content of B (mass %) | $Nb_{ER}$ (mass %) | Left side value of Formula (v) | Right side value of Formula (v) | Amount of dissolved Nb Middle value of Formula (i) (mass %) | Creep rupture test | Restraint Weld cracking test | |
|---|---|---|---|---|---|---|---|---|---|
| A1 | 0.502 | 0.0038 | 0.251 | 0.177 | 0.465 | 0.251 | Good (excellent) | Good (excellent) | Inventive example |
| A2 | 0.502 | 0.0038 | 0.288 | 0.177 | 0.465 | 0.214 | Good (excellent) | Good (excellent) | |
| A3 | 0.502 | 0.0038 | 0.270 | 0.177 | 0.465 | 0.232 | Good (excellent) | Good (excellent) | |
| A4 | 0.502 | 0.0038 | 0.217 | 0.177 | 0.465 | 0.285 | Good (excellent) | Good (excellent) | |
| A5 | 0.502 | 0.0038 | 0.202 | 0.177 | 0.465 | 0.300 | Good (excellent) | Good (excellent) | |
| A6 | 0.502 | 0.0038 | 0.190 | 0.177 | 0.465 | 0.312 | Good (excellent) | Good (excellent) | |
| A7 | 0.502 | 0.0038 | 0.315 | 0.177 | 0.465 | 0.187 | Good (excellent) | Good (excellent) | |
| A8 | 0.502 | 0.0038 | 0.373 | 0.177 | 0.465 | 0.129 * | Failed | Good (excellent) | Comparative example |
| A9 | 0.502 | 0.0038 | 0.331 | 0.177 | 0.465 | 0.171 † | Good (acceptable) | Good (excellent) | Inventive example |
| A10 | 0.502 | 0.0038 | 0.308 | 0.177 | 0.465 | 0.194 | Good (excellent) | Good (excellent) | Inventive example |
| A11 | 0.502 | 0.0038 | 0.298 | 0.177 | 0.465 | 0.204 | Good (excellent) | Good (excellent) | |
| A12 | 0.502 | 0.0038 | 0.290 | 0.177 | 0.465 | 0.212 | Good (excellent) | Good (excellent) | |

TABLE 2-continued

| | | | | | | | | | |
|---|---|---|---|---|---|---|---|---|---|
| A13 | 0.502 | 0.0038 | 0.161 | 0.177 | 0.465 | 0.341 | Good (excellent) | Good (excellent) | |
| A14 | 0.502 | 0.0038 | 0.213 | 0.177 | 0.465 | 0.289 | Good (excellent) | Good (excellent) | |
| A15 | 0.502 | 0.0038 | 0.204 | 0.177 | 0.465 | 0.298 | Good (excellent) | Good (excellent) | |
| A16 | 0.502 | 0.0038 | 0.132 | 0.177 | 0.465 | 0.370 | Good (excellent) | Good (excellent) | |
| A17 | 0.502 | 0.0038 | 0.121 | 0.177 | 0.465 | 0.381 | Good (excellent) | Good (excellent) | |
| A18 | 0.502 | 0.0038 | 0.110 | 0.177 | 0.465 | 0.392 | Good (excellent) | Failed | Comparative example |
| A19 | 0.502 | 0.0038 | 0.368 | 0.177 | 0.465 | 0.134 * | Failed | Good (excellent) | |
| A20 | 0.502 | 0.0038 | 0.108 | 0.177 | 0.465 | 0.394 | Good (excellent) | Good (excellent) | Inventive example |
| A21 | 0.502 | 0.0038 | 0.230 | 0.177 | 0.465 | 0.272 | Good (excellent) | Good (excellent) | |
| A22 | 0.502 | 0.0038 | 0.302 | 0.177 | 0.465 | 0.200 | Good (excellent) | Good (excellent) | |
| A23 | 0.502 | 0.0038 | 0.272 | 0.177 | 0.465 | 0.230 | Good (excellent) | Good (excellent) | |
| A24 | 0.502 | 0.0038 | 0.297 | 0.177 | 0.465 | 0.205 | Good (excellent) | Good (excellent) | |
| A25 | 0.502 | 0.0038 | 0.327 | 0.177 | 0.465 | 0.175 † | Good (acceptable) | Good (excellent) | |
| A26 | 0.502 | 0.0038 | 0.228 | 0.177 | 0.465 | 0.274 | Failed | Good (excellent) | Comparative example |
| A27 | 0.502 | 0.0038 | 0.220 | 0.177 | 0.465 | 0.282 | Good (excellent) | Good (excellent) | Inventive example |
| A28 | 0.502 | 0.0038 | 0.115 | 0.177 | 0.465 | 0.387 | Good (excellent) | Good (excellent) | |
| A29 | 0.502 | 0.0038 | 0.113 | 0.177 | 0.465 | 0.389 | Good (excellent) | Failed | Comparative example |
| A30 | 0.502 | 0.0038 | 0.330 | 0.177 | 0.465 | 0.172 † | Good (acceptable) | Good (excellent) | Inventive example |
| A31 | 0.502 | 0.0038 | 0.102 | 0.177 | 0.465 | 0.400 | Good (excellent) | Failed | Comparative example |
| B1 | 0.479 | 0.0040 | 0.233 | 0.177 | 0.464 | 0.246 | Good (excellent) | Good (excellent) | Invent example |

The mark "*" indicates that a value with the mark fell out of the range specified in the present invention.
The mark "**" indicates that a value with the mark fell out of the preferable range specified in the present invention.
The mark "†" indicates that a value with the mark fell out of Formula (v).
The underline indicates that an underlined value fell out of its targeted property value according to the present invention.

$0.170 \leq Nb - Nb_{ER} \leq 0.480$ (i)

$-250Nb + 1200 \leq T \leq -100Nb + 1290$ (ii)

$405 - 0.3T \leq t \leq 2475 - 1.5T$ (iii)

$0 \leq \Delta T \leq 100Nb - 5$ (iv)

$-2B + 0.185 \leq Nb - Nb_{ER} \leq -4B + 0.480$ (v)

TABLE 3

| | | | Solution heat treatment step | | | | | | Cooling step | | |
|---|---|---|---|---|---|---|---|---|---|---|---|
| Test piece | Steel type | Forming step Processing method | Heat treatment temperature T (° C.) | Left side value of Formula (ii) | Right side value of Formula (ii) | Soaking time t(s) | Left side value of Formula (iii) | Right side value of Formula (iii) | Cooling start temperature difference ΔT (° C.) | Right side value of Formula (iv) | Cooling method |
| C1 | C | Cold rolling | 1150 | 1042 | 1227 | 120 | 60 | 750 | 0 | 58.1 | Water cooling |
| C2 | C | Cold rolling | 1150 | 1042 | 1227 | 60 | 60 | 750 | 0 | 58.1 | Water cooling |
| C3 | C | Cold rolling | 1150 | 1042 | 1227 | 90 | 60 | 750 | 0 | 58.1 | Water cooling |
| C4 | C | Cold rolling | 1150 | 1042 | 1227 | 300 | 60 | 750 | 0 | 58.1 | Water cooling |
| C5 | C | Cold rolling | 1150 | 1042 | 1227 | 600 | 60 | 750 | 0 | 58.1 | Water cooling |
| C6 | C | Cold rolling | 1150 | 1042 | 1227 | 720 | 60 | 750 | 0 | 58.1 | Water cooling |
| C7 | C | Cold rolling | 1100 | 1042 | 1227 | 120 | 75 | 825 | 0 | 58.1 | Water cooling |
| C8 | C | Cold rolling | 1100 | 1042 | 1227 | 60 * | 75 | 825 | 0 | 58.1 | Water cooling |

TABLE 3-continued

| | | | | | | | | | | | |
|---|---|---|---|---|---|---|---|---|---|---|---|
| C9 | C | Cold rolling | 1100 | 1042 | 1227 | 90 | 75 | 825 | 0 | 58.1 | Water cooling |
| C10 | C | Cold rolling | 1100 | 1042 | 1227 | 300 | 75 | 825 | 0 | 58.1 | Water cooling |
| C11 | C | Cold rolling | 1100 | 1042 | 1227 | 600 | 75 | 825 | 0 | 58.1 | Water cooling |
| C12 | C | Cold rolling | 1100 | 1042 | 1227 | 720 | 75 | 825 | 0 | 58.1 | Water cooling |
| C13 | C | Cold rolling | 1200 | 1042 | 1227 | 120 | 45 | 675 | 0 | 58.1 | Water cooling |
| C14 | C | Cold rolling | 1200 | 1042 | 1227 | 60 | 45 | 675 | 0 | 58.1 | Water cooling |
| C15 | C | Cold rolling | 1200 | 1042 | 1227 | 90 | 45 | 675 | 0 | 58.1 | Water cooling |
| C16 | C | Cold rolling | 1200 | 1042 | 1227 | 300 | 45 | 675 | 0 | 58.1 | Water cooling |
| C17 | C | Cold rolling | 1200 | 1042 | 1227 | 600 | 45 | 675 | 0 | 58.1 | Water cooling |
| C18 | C | Cold rolling | 1200 | 1042 | 1227 | 720 * | 45 | 675 | 0 | 58.1 | Water cooling |
| C19 | C | Cold rolling | 1070 | 1042 | 1227 | 120 | 84 | 870 | 0 | 58.1 | Water cooling |
| C20 | C | Cold rolling | 1230 * | 1042 | 1227 | 120 | 36 | 630 | 0 | 58.1 | Water cooling |
| C21 | C | Hot rolling | 1150 | 1042 | 1227 | 120 | 60 | 750 | 0 | 58.1 | Water cooling |
| C22 | C | Cold rolling | 1150 | 1042 | 1227 | 120 | 60 | 750 | 0 | 58.1 | Forced air cooling |
| C23 | C | Cold rolling | 1150 | 1042 | 1227 | 120 | 60 | 750 | 10 | 58.1 | Water cooling |
| C24 | C | Cold rolling | 1150 | 1042 | 1227 | 120 | 60 | 750 | 30 | 58.1 | Water cooling |
| C25 | C | Cold rolling | 1150 | 1042 | 1227 | 120 | 60 | 750 | 50 | 58.1 | Water cooling |

| Test piece | Content of Nb (mass %) | Content of B (mass %) | $Nb_{ER}$ (mass %) | Left side value of Formula (v) | Right side value of Formula (v) | Amount of dissolved Nb Middle value of Formula (i) (mass %) | Creep rupture test | Restraint weld cracking test | |
|---|---|---|---|---|---|---|---|---|---|
| C1 | 0.631 | 0.0029 | 0.271 | 0.179 | 0.468 | 0.360 | Good (excellent) | Good (excellent) | Inventive example |
| C2 | 0.631 | 0.0029 | 0.302 | 0.179 | 0.468 | 0.329 | Good (excellent) | Good (excellent) | |
| C3 | 0.631 | 0.0029 | 0.287 | 0.179 | 0.468 | 0.344 | Good (excellent) | Good (excellent) | |
| C4 | 0.631 | 0.0029 | 0.260 | 0.179 | 0.468 | 0.371 | Good (excellent) | Good (excellent) | |
| C5 | 0.631 | 0.0029 | 0.240 | 0.179 | 0.468 | 0.391 | Good (excellent) | Good (excellent) | |
| C6 | 0.631 | 0.0029 | 0.207 | 0.179 | 0.468 | 0.424 | Good (excellent) | Good (excellent) | |
| C7 | 0.631 | 0.0029 | 0.350 | 0.179 | 0.468 | 0.281 | Good (excellent) | Good (excellent) | |
| C8 | 0.631 | 0.0029 | 0.402 | 0.179 | 0.468 | 0.229 | Failed | Good (excellent) | Comparative example |
| C9 | 0.631 | 0.0029 | 0.366 | 0.179 | 0.468 | 0.265 | Good (excellent) | Good (excellent) | Inventive example |
| C10 | 0.631 | 0.0029 | 0.340 | 0.179 | 0.468 | 0.291 | Good (excellent) | Good (excellent) | |
| C11 | 0.631 | 0.0029 | 0.332 | 0.179 | 0.468 | 0.299 | Good (excellent) | Good (excellent) | |
| C12 | 0.631 | 0.0029 | 0.301 | 0.179 | 0.468 | 0.330 | Good (excellent) | Good (excellent) | |
| C13 | 0.631 | 0.0029 | 0.172 | 0.179 | 0.468 | 0.459 | Good (excellent) | Good (excellent) | |
| C14 | 0.631 | 0.0029 | 0.221 | 0.179 | 0.468 | 0.410 | Good (excellent) | Good (excellent) | |
| C15 | 0.631 | 0.0029 | 0.197 | 0.179 | 0.468 | 0.434 | Good (excellent) | Good (excellent) | |
| C16 | 0.631 | 0.0029 | 0.161 | 0.179 | 0.468 | 0.470 † | Good (excellent) | Good (acceptable) | Inventive example |
| C17 | 0.631 | 0.0029 | 0.152 | 0.179 | 0.468 | 0.479 † | Good (excellent) | Good (acceptable) | |

TABLE 3-continued

| | | | | | | | | | |
|---|---|---|---|---|---|---|---|---|---|
| C18 | 0.631 | 0.0029 | 0.120 | 0.179 | 0.468 | 0.511 * | Good (excellent) | Failed | Comparative example |
| C19 | 0.631 | 0.0029 | 0.383 | 0.179 | 0.468 | 0.248 | Good (excellent) | Good (excellent) | Inventive example |
| C20 | 0.631 | 0.0029 | 0.122 | 0.179 | 0.468 | 0.509 * | Good (excellent) | Failed | Comparative example |
| C21 | 0.631 | 0.0029 | 0.250 | 0.179 | 0.468 | 0.381 | Good (excellent) | Good (excellent) | Inventive example |
| C22 | 0.631 | 0.0029 | 0.335 | 0.179 | 0.468 | 0.296 | Good (excellent) | Good (excellent) | |
| C23 | 0.631 | 0.0029 | 0.301 | 0.179 | 0.468 | 0.330 | Good (excellent) | Good (excellent) | |
| C24 | 0.631 | 0.0029 | 0.324 | 0.179 | 0.468 | 0.307 | Good (excellent) | Good (excellent) | |
| C25 | 0.631 | 0.0029 | 0.351 | 0.179 | 0.468 | 0.280 | Good (excellent) | Good (excellent) | |

The mark "*" indicates that a value with the mark fell out of the range specified in the present invention.
The mark "**" indicates that a value with the mark fell out of the preferable range specified in the present invention.
The mark "†" indicates that a value with the mark fell out of Formula (v).
The underline indicates that an underlined value fell out of its targeted property value according to the present invention.

$0.170 \leq Nb - Nb_{ER} \leq 0.480$ (i)

$-250Nb + 1200 \leq T \leq -100Nb + 1290$ (ii)

$405 - 0.3T \leq t \leq 2475 - 1.5T$ (iii)

$0 \leq \Delta T \leq 100Nb - 5$ (iv)

$-2B + 0.185 \leq Nb - Nb_{ER} \leq -4B + 0.480$ (v)

TABLE 4

| | | | Solution heat treatment step | | | | | | Cooling step | | |
|---|---|---|---|---|---|---|---|---|---|---|---|
| | | | | | | | | | Cooling | | |
| Test piece | Steel type | Forming step Processing method | Heat treatment temperature T (° C.) | Left side value of Formula (ii) | Right side value of Formula (ii) | Soaking time t(s) | Left side value of Formula (iii) | Right side value of Formula (iii) | start temperature difference ΔT (° C.) | Right side value of Formula (iv) | Cooling method |
| D1 | D | Cold rolling | 1150 | 1087 | 1245 | 120 | 60 | 750 | 0 | 40.2 | Water cooling |
| E1 | E | Cold rolling | 1150 | 1096 | 1248 | 120 | 60 | 750 | 0 | 36.7 | Water cooling |
| E2 | E | Cold rolling | 1150 | 1096 | 1248 | 60 | 60 | 750 | 0 | 36.7 | Water cooling |
| E3 | E | Cold rolling | 1150 | 1096 | 1248 | 90 | 60 | 750 | 0 | 36.7 | Water cooling |
| E4 | E | Cold rolling | 1150 | 1096 | 1248 | 300 | 60 | 750 | 0 | 36.7 | Water cooling |
| E5 | E | Cold rolling | 1150 | 1096 | 1248 | 600 | 60 | 750 | 0 | 36.7 | Water cooling |
| E6 | E | Cold rolling | 1150 | 1096 | 1248 | 720 | 60 | 750 | 0 | 36.7 | Water cooling |
| E7 | E | Cold rolling | 1200 | 1096 | 1248 | 120 | 45 | 675 | 0 | 36.7 | Water cooling |
| E8 | E | Cold rolling | 1200 | 1096 | 1248 | 60 | 45 | 675 | 0 | 36.7 | Water cooling |
| E9 | E | Cold rolling | 1200 | 1096 | 1248 | 90 | 45 | 675 | 0 | 36.7 | Water cooling |
| E10 | E | Cold rolling | 1200 | 1096 | 1248 | 300 | 45 | 675 | 0 | 36.7 | Water cooling |
| E11 | E | Cold rolling | 1200 | 1096 | 1248 | 600 | 45 | 675 | 0 | 36.7 | Water cooling |
| E12 | E | Cold rolling | 1200 | 1096 | 1248 | 720 * | 45 | 675 | 0 | 36.7 | Water cooling |
| E13 | E | Cold rolling | 1070 * | 1096 | 1248 | 120 | 84 | 870 | 0 | 36.7 | Water cooling |
| E14 | E | Cold rolling | 1230 | 1096 | 1248 | 120 | 36 | 630 | 0 | 36.7 | Water cooling |
| E15 | E | Hot rolling | 1150 | 1096 | 1248 | 120 | 60 | 750 | 0 | 36.7 | Water cooling |
| E16 | E | Cold rolling | 1150 | 1096 | 1248 | 120 | 60 | 750 | 0 | 36.7 | Forced air cooling |
| E17 | E | Cold rolling | 1150 | 1096 | 1248 | 120 | 60 | 750 | 10 | 36.7 | Water cooling |
| E19 | E | Cold rolling | 1150 | 1096 | 1248 | 120 | 60 | 750 | 50 ** | 36.7 | Water cooling |

TABLE 4-continued

| | | | | | | | | | | | |
|---|---|---|---|---|---|---|---|---|---|---|---|
| F1 | F | Cold rolling | 1150 | 1050 | 1230 | 120 | 60 | 750 | 0 | 55.0 | Water cooling |
| G1 | G | Cold rolling | 1150 | 1098 | 1249 | 120 | 60 | 750 | 0 | 36.0 | Water cooling |
| H1 | H | Cold rolling | 1150 | 1096 | 1248 | 120 | 60 | 750 | 0 | 36.8 | Water cooling |
| I1 | I * | Cold rolling | 1150 | 1105 | 1252 | 120 | 60 | 750 | 0 | 32.9 | Water cooling |
| J1 | J * | Cold rolling | 1150 | 1027 | 1221 | 120 | 60 | 750 | 0 | 64.2 | Water cooling |
| K1 | K | Cold rolling | 1150 | 1095 | 1248 | 120 | 60 | 750 | 0 | 37.2 | Water cooling |

| Test piece | Content of Nb (mass %) | Content of B (mass %) | $Nb_{ES}$ (mass %) | Left side value of Formula (v) | Right side value of Formula (v) | Amount of dissolved Nb Middle value of Formula (i) (mass %) | Creep rupture test | Restraint weld cracking test | |
|---|---|---|---|---|---|---|---|---|---|
| D1 | 0.452 | 0.0053 | 0.220 | 0.174 | 0.459 | 0.232 | Good (excellent) | Good (excellent) | Inventive example |
| E1 | 0.417 | 0.0020 | 0.233 | 0.181 | 0.472 | 0.184 | Good (excellent) | Good (excellent) | |
| E2 | 0.417 | 0.0020 | 0.247 | 0.181 | 0.472 | 0.170 † | Good (excellent) | Good (excellent) | |
| E3 | 0.417 | 0.0020 | 0.238 | 0.181 | 0.472 | 0.179 † | Good (excellent) | Good (excellent) | |
| E4 | 0.417 | 0.0020 | 0.197 | 0.181 | 0.472 | 0.220 | Good (excellent) | Good (excellent) | |
| E5 | 0.417 | 0.0020 | 0.190 | 0.181 | 0.472 | 0.227 | Good (excellent) | Good (excellent) | |
| E6 | 0.417 | 0.0020 | 0.189 | 0.181 | 0.472 | 0.228 | Good (excellent) | Good (excellent) | |
| E7 | 0.417 | 0.0020 | 0.154 | 0.181 | 0.472 | 0.263 | Good (excellent) | Good (excellent) | |
| E8 | 0.417 | 0.0020 | 0.188 | 0.181 | 0.472 | 0.229 | Good (excellent) | Good (excellent) | |
| E9 | 0.417 | 0.0020 | 0.177 | 0.181 | 0.472 | 0.240 | Good (excellent) | Good (excellent) | |
| E10 | 0.417 | 0.0020 | 0.141 | 0.181 | 0.472 | 0.276 | Good (excellent) | Good (excellent) | |
| E11 | 0.417 | 0.0020 | 0.134 | 0.181 | 0.472 | 0.283 | Good (excellent) | Good (excellent) | |
| E12 | 0.417 | 0.0020 | 0.130 | 0.181 | 0.472 | 0.287 | Good (excellent) | Failed | Comparative example |
| E13 | 0.417 | 0.0020 | 0.317 | 0.181 | 0.472 | 0.100 * | Failed | Good (excellent) | |
| E14 | 0.417 | 0.0020 | 0.090 | 0.181 | 0.472 | 0.327 | Good (excellent) | Good (excellent) | Inventive example |
| E15 | 0.417 | 0.0020 | 0.202 | 0.181 | 0.472 | 0.215 | Good (excellent) | Good (excellent) | |
| E16 | 0.417 | 0.0020 | 0.236 | 0.181 | 0.472 | 0.181 | Good (excellent) | Good (excellent) | |
| E17 | 0.417 | 0.0020 | 0.234 | 0.181 | 0.472 | 0.183 | Good (excellent) | Good (excellent) | |
| E19 | 0.417 | 0.0020 | 0.245 | 0.181 | 0.472 | 0.172 † | Good (excellent) | Good (excellent) | |
| F1 | 0.600 | 0.0050 | 0.258 | 0.175 | 0.460 | 0.342 | Good (excellent) | Good (excellent) | |
| G1 | 0.410 | 0.00I5 | 0.229 | 0.182 | 0.474 | 0.181 † | Good (acceptable) | Good (excellent) | |
| H1 | 0.418 | 0.0014 | 0.238 | 0.182 | 0.474 | 0.180 † | Good (acceptable) | Good (excellent) | |
| I1 | 0.379 | 0.0014 | 0.203 | 0.182 | 0.474 | 0.176 † | Failed | Good (excellent) | Comparative example |
| J1 | 0.692 | 0.0055 | 0.302 | 0.174 | 0.458 | 0.390 | Good (excellent) | Failed | |
| K1 | 0.422 | 0.0013 | 0.240 | 0.182 | 0.475 | 0.182 | Good (excellent) | Good (excellent) | Inventive example |

The mark "*" indicates that a value with the mark fell out of the range specified in the present invention.
The mark "**" indicates that a value with the mark fell out of the preferable range specified in the present invention.
The mark "†" indicates that a value with the mark fell out of Formula (v).
The underline indicates that an undedined value fell out of its targeted property value according to the present invention.

$0.170 \leq Nb - Nb_{ER} \leq 0.480$ (i)

$-250Nb + 1200 \leq T \leq -100Nb + 1290$ (ii)

$405 - 0.3T \leq t \leq 2475 - 1.5T$ (iii)

$0 \leq \Delta T \leq 100Nb - 5$ (iv)

$-2B + 0.185 \leq Nb - Nb_{ER} \leq -4B + 0.480$ (v)

From Tables 2 to 4, it is found that test pieces for which the steel types A to F satisfying chemical components specified in the present invention were used and which satisfy the specification according to the present invention in amounts of dissolved Nb as being the middle value of Formula (i) by performing appropriate solution heat treatment each provided a favorable creep strength and had a sufficient weld crack resistance. In addition, it is also found that an amount of dissolved Nb satisfying a relation with the amount of B expressed in Formula (v) is preferable in order to provide these properties stably.

Further, comparison of a test piece E1 with test pieces G1, H1, and K1, shows that containing P in a large amount is preferable in order to provide creep strength stably. In addition, comparison between test pieces A24 and A25 and comparison between test pieces E16 and E19 show that a cooling start temperature difference satisfying a predetermined range is preferable. Comparison of the test piece E19 with the other examples shows that a cooling start temperature difference satisfying Formula (iv) improves creep strength.

In contrast, for test pieces A26 and C8, soaking times were shorter than their specified range, and thus the removal of residual strain induced in the forming step was insufficient, failing to provide a creep strength as being targeted. Further, for test pieces A8, A19, and E13, heat treatment temperatures were lower than their specified range or a soaking time was shorter than its specified range, and moreover, their amounts of dissolved Nb were smaller than their specified range; therefore, their precipitation amounts in the creep test were insufficient, failing to provide a creep strength as being targeted.

For test pieces A18, A29, A31, and E12, a heat treatment temperature was higher than its specified range, or soaking times were longer than their specified range, which causes grains to coarsen, failing to provide a weld crack resistance as being targeted. In addition to the above, test pieces C18 and C20 had amounts of dissolved Nb that exceeded their specified range; therefore, weld cracks occurred at their weld heat affected zones due to segregation of Nb, failing to provide a weldability as being targeted.

A test piece I1 for which a symbol I was used had a content of Nb that fell below its range specified in the present invention, and thus its precipitation amount of precipitate containing Nb was insufficient, failing to provide a creep strength as being targeted. A test piece J1 for which a symbol J was used had a content of Nb that exceeded its range specified in the present invention; therefore, cracks occurred at its weld heat affected zone due to segregation of Nb, failing to provide a weld crack resistance as being targeted.

INDUSTRIAL APPLICABILITY

According to the present invention, it is possible to provide an austenitic heat resistant steel having a stable, favorable creep strength and an excellent weld crack resistance in its use at high temperature.

The invention claimed is:

1. A method for producing an austenitic steel in which a difference between a content of Nb and an amount of Nb analyzed as extraction residues satisfies Formula (i) shown below, the method comprising:

a forming step of machining and forming a steel into a product shape, the steel including a chemical composition consisting of, in mass %:

C: 0.04 to 0.12%,
Si: 0.01 to 0.30%,
Mn: 0.50 to 1.50%,
P: 0.001 to 0.040%,
S: 0.0050% or less,
Cu: 2.2 to 3.8%,
Ni: 8.0 to 11.0%,
Cr: 17.7 to 19.3%,
Mo: 0.01 to 0.55%,
Nb: 0.400 to 0.650%,
B: 0.0010 to 0.0060%,
N: 0.050 to 0.160%,
Al: 0.025% or less,
O: 0.020% or less,
Co: 0 to 1.00%,
W: 0 to 1.00%,
Ti: 0 to 0.40%,
V: 0 to 0.40%,
Ta: 0 to 0.40%,
Sn: 0 to 0.0300%,
Ca: 0 to 0.0100%,
Mg: 0 to 0.0100%, and
REM: 0 to 0.0800%,
with the balance: Fe and impurities;

a solution heat treatment step of performing, after the forming step, heat treatment under conditions including a heat treatment temperature satisfying Formula (ii) shown below and a soaking time satisfying Formula (iii) shown below; and a cooling step of performing cooling after the solution heat treatment step:

$$0.170 \leq \mathrm{Nb} - \mathrm{Nb}_{ER} \leq 0.480 \quad \text{(i)}$$

$$-250\mathrm{Nb} + 1200 \leq T \leq -100\mathrm{Nb} + 1290 \quad \text{(ii)}$$

$$405 - 0.3T \leq t \leq 2475 - 1.5T \quad \text{(iii)}$$

where a symbol of an element in the formulas indicates a content (mass %) of the element contained in the steel, and symbols in the formulas are defined as follows:

$\mathrm{Nb}_{ER}$ (mass %): amount of Nb analyzed as extraction residues

T (° C.): heat treatment temperature t (sec): soaking time.

2. The method for producing an austenitic steel according to claim 1, wherein in the cooling step, the cooling is performed in a form of forced cooling, and a difference between the heat treatment temperature and a temperature of the steel at a time of starting the forced cooling satisfies Formula (iv) shown below:

$$0 \leq \Delta T \leq 100\mathrm{Nb} - 5 \quad \text{(iv)}$$

where a symbol of an element in the formula indicates a content (mass %) of the element contained in the steel, and a symbol in the formula is defined as follows:

ΔT (° C.): difference between the heat treatment temperature of the solution heat treatment and the temperature of the steel at the time of starting the forced cooling.

3. The method for producing an austenitic steel according to claim 1, wherein a difference between a content of Nb and an amount of Nb analyzed as extraction residues satisfies Formula (v) shown below:

$$-2B + 0.185 \leq \mathrm{Nb} - \mathrm{Nb}_{ER} \leq -4B + 0.480 \quad \text{(v)}$$

where symbols of elements in the formula mean the contents (mass %) of the elements contained in the steel, and $\mathrm{Nb}_{ER}$ means the amount of Nb (mass %) analyzed as extraction residues.

4. The method for producing an austenitic steel according to claim 1, wherein the chemical composition contains one or more elements selected from, in mass %:

Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

5. The method for producing an austenitic steel according to claim 1, wherein the chemical composition contains, in mass %, P: 0.020 to 0.040%.

6. The method for producing an austenitic steel according to claim 2, wherein a difference between a content of Nb and an amount of Nb analyzed as extraction residues satisfies Formula (v) shown below:

$$-2B + 0.185 \leq \mathrm{Nb} - \mathrm{Nb}_{ER} \leq -4B + 0.480 \quad \text{(v)}$$

where symbols of elements in the formula mean the contents (mass %) of the elements contained in the steel, and $\mathrm{Nb}_{ER}$ means the amount of Nb (mass %) analyzed as extraction residues.

7. The method for producing an austenitic steel according to claim 2, wherein the chemical composition contains one or more elements selected from, in mass %:

Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

8. The method for producing an austenitic steel according to claim 3, wherein the chemical composition contains one or more elements selected from, in mass %:

Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

9. The method for producing an austenitic steel according to claim 6, wherein the chemical composition contains one or more elements selected from, in mass %:

Co: 0.01 to 1.00%,
W: 0.01 to 1.00%,
Ti: 0.01 to 0.40%,
V: 0.01 to 0.40%,
Ta: 0.01 to 0.40%,
Sn: 0.0002 to 0.0300%,
Ca: 0.0002 to 0.0100%,
Mg: 0.0002 to 0.0100%, and
REM: 0.0005 to 0.0800%.

10. The method for producing an austenitic steel according to claim 2, wherein the chemical composition contains, in mass %, P: 0.020 to 0.040%.

11. The method for producing an austenitic steel according to claim 3, wherein the chemical composition contains, in mass %, P: 0.020 to 0.040%.

12. The method for producing an austenitic steel according to claim 4, wherein the chemical composition contains, in mass %, P: 0.020 to 0.040%.

13. The method for producing an austenitic steel according to claim 6, wherein the chemical composition contains, in mass %, P: 0.020 to 0.040%.

14. The method for producing an austenitic according to claim 7, wherein the chemical composition contains, in mass %, P: 0.020 to 0.040%.

15. The method for producing an austenitic steel according to claim 8, wherein the chemical composition contains, in mass %, P: 0.020 to 0.040%.

16. The method for producing an austenitic steel according to claim 9, wherein the chemical composition contains, in mass %, P: 0.020 to 0.040%.

* * * * *